US009739071B2

(12) United States Patent
Deel et al.

(10) Patent No.: US 9,739,071 B2
(45) Date of Patent: Aug. 22, 2017

(54) METHODS AND APPARATUSES FOR ELEVATING DRILLING RIG COMPONENTS WITH A STRAND JACK

(71) Applicant: NABORS INDUSTRIES, INC., Houston, TX (US)

(72) Inventors: Steven K. Deel, Cypress, TX (US); Christopher Magnuson, Houston, TX (US)

(73) Assignee: Nabors Industries, Inc., Houston, TX (US)

( * ) Notice: Subject to any disclaimer, the term of this patent is extended or adjusted under 35 U.S.C. 154(b) by 0 days.

(21) Appl. No.: 15/055,137

(22) Filed: Feb. 26, 2016

(65) Prior Publication Data

US 2016/0251869 A1 Sep. 1, 2016

Related U.S. Application Data

(60) Provisional application No. 62/121,679, filed on Feb. 27, 2015.

(51) Int. Cl.
*E04H 12/34* (2006.01)
*E21B 15/00* (2006.01)

(52) U.S. Cl.
CPC ..... *E04H 12/34* (2013.01); *E04H 12/345* (2013.01); *E21B 15/00* (2013.01)

(58) Field of Classification Search
CPC ..... E21B 15/00; E04H 12/34; E04H 12/345
USPC ..... 52/120
See application file for complete search history.

(56) References Cited

U.S. PATENT DOCUMENTS

| | | | | |
|---|---|---|---|---|
| 2,937,008 | A | 5/1960 | Whittle | |
| 3,802,137 | A | 4/1974 | Armstrong | |
| 4,221,088 | A * | 9/1980 | Patterson | E21B 15/00 52/116 |
| 4,478,015 | A * | 10/1984 | Lawrence | E21B 15/00 52/116 |
| 4,578,911 | A * | 4/1986 | Hashimoto | E21B 15/00 52/116 |
| 4,791,999 | A | 12/1988 | Skeie | |
| 4,813,493 | A | 3/1989 | Shaw et al. | |
| 4,899,959 | A | 2/1990 | Weiler | |
| 5,921,329 | A | 7/1999 | Armstrong | |
| 6,056,071 | A | 5/2000 | Scott et al. | |
| 6,561,155 | B1 | 5/2003 | Williams | |
| 6,725,949 | B2 | 4/2004 | Seneviratne | |
| 7,270,189 | B2 | 9/2007 | Brown et al. | |
| 7,401,664 | B2 | 7/2008 | Wells et al. | |

(Continued)

OTHER PUBLICATIONS

ISA/US, International Search Report and Written Opinion of the International Searching Authority, PCT/US2006/62414, mailed Oct. 15, 2007, 8 pages.

(Continued)

*Primary Examiner* — Andrew J Triggs
(74) *Attorney, Agent, or Firm* — Haynes & Boone, LLP

(57) ABSTRACT

Apparatuses and methods for erecting drilling structures including drill floors and drilling masts include attaching a rigging line to the drilling structure and to a strand jack arranged with at least one hydraulic jack and a plurality of clamps that alternatingly secure onto the rigging line and pull the rigging line in tension. Pulling the rigging line with the strand jack raises the drilling structures to an upright or elevated position.

22 Claims, 11 Drawing Sheets

(56) References Cited

U.S. PATENT DOCUMENTS

| | | | | |
|---|---|---|---|---|
| 7,500,531 | B2 | 3/2009 | Williams et al. | |
| 7,673,675 | B2 | 3/2010 | Carr et al. | |
| 7,743,853 | B2 | 6/2010 | Rudshaug et al. | |
| 7,748,473 | B2 | 7/2010 | Wells et al. | |
| 7,828,085 | B2 | 11/2010 | Kuttel et al. | |
| 7,828,087 | B2 * | 11/2010 | Vora | E21B 15/00 175/162 |
| 8,151,909 | B2 | 4/2012 | Kuttel et al. | |
| 2005/0279507 | A1 | 12/2005 | Folk et al. | |
| 2006/0096751 | A1 | 5/2006 | Brown et al. | |
| 2007/0039758 | A1 | 2/2007 | Klipstein | |
| 2007/0140801 | A1 | 6/2007 | Kuttel et al. | |
| 2007/0209878 | A1 | 9/2007 | Czechowski et al. | |
| 2007/0240908 | A1 | 10/2007 | Brown et al. | |
| 2012/0160570 | A1 | 6/2012 | Kuttel et al. | |
| 2016/0251869 | A1 * | 9/2016 | Deel | E21B 15/00 |

OTHER PUBLICATIONS

WIPO, International Preliminary Report on Patentability, PCT/US2006/62414, issued Jun. 24, 2008, 6 pages.

European Patent Office, European Search Report dated Feb. 27, 2012, Application No. 06846724.0-1266/1984137 PCT/US2006062414, 7 pages.

"Fast Land Rig Designed for Drilling Contractors & Rig Movers" http://vengineer.com/land-rig html, 2011, 2 pages.

* cited by examiner

METHODS AND APPARATUSES FOR ELEVATING DRILLING RIG COMPONENTS WITH A STRAND JACK

PRIORITY

This application claims the benefit of the filing date of U.S. Provisional Application 62/121,679, filed Feb. 27, 2015, which is incorporated in its entirety herein by reference.

TECHNICAL FIELD

This disclosure relates to the field of erecting drilling rig structures. More particularly, this disclosure relates to the field of erecting drilling rig structures using a strand jack.

BACKGROUND OF THE DISCLOSURE

Exploration and production of petroleum, including oil and gas require the use of drilling rigs to drill wells deep in subterranean formations. These wells are expensive to both drill and operate. Advancements in technology have permitted deeper wells, which in turn have resulted in a need to have drill floors be higher above the ground in order to accommodate larger and more complex equipment, such as blow-out preventers (BOPs) with more cavities and rotating BOPs.

A typical operating drilling rig includes a substructure, a drill floor, and a vertical mast with a crown mounted thereon. The mast typically has a traveling block reeved with wire rope from a drawworks to the crown, enabling the traveling block to be raised and lowered. A top drive is connected to the block for drilling the well. The drill floor typically includes the drawworks, an automated roughneck, and a rotary table with a bowl to accept manual or automated slips for the securing and holding of tubulars.

In order to accommodate the need for an elevated drill floor, numerous structures and raising systems have evolved, but each has proven deficiencies. For example, conventional systems have utilized drawworks, hydraulic cylinders, and/or winches to raise the mast and drill floor. However, those structures requiring the use of the drawworks for the raising of the mast must wait until all loads of the rig have been moved and its supporting generators, SCR/drives and control system are operational. Accordingly, the drill site must be substantially set up even before the mast can be raised. This delay is extremely expensive and requires the rig operating footprint to be great enough to accommodate the un-erected substructure, mast (in horizontal position) and all its loads.

Some prior mast raising systems utilize a plurality of hydraulic cylinders that lift the mast from a horizontal position to a vertical position. However, these are very large, are very expensive, and risk hydraulic failure or uneven extension which can introduce some level of torque to the mast that may cause damage. In addition, these types of hydraulic cylinders require intensive maintenance programs. Hydraulic cylinders with counterbalance valves to prevent the uncontrolled retracting of the cylinders are still susceptible to seal failures. A seal failure often results in damage to the mast and/or substructure.

The present disclosure is directed to overcoming one or more of the deficiencies of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
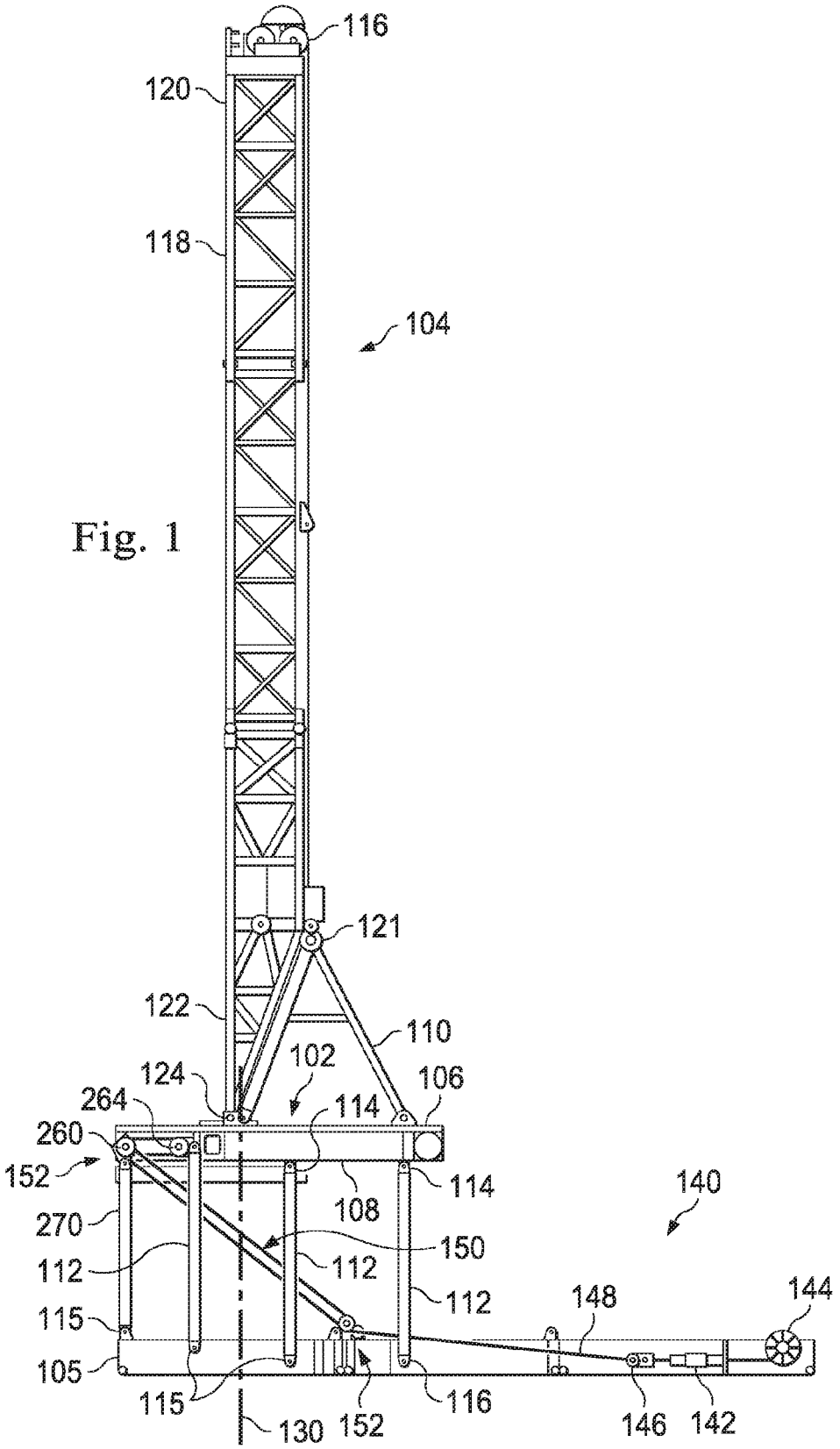
FIG. 1 is a side view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The apparatuses and methods described in the present disclosure may enable faster setup of drill floors and masts in a manner reducing operating and equipment costs when compared to costs of conventional systems and methods. In addition, the apparatuses and methods described herein may decrease the rig-up time, such as erecting drilling rig structures, such as a drill floor and/or a mast, when compared to the time required to rig-up using conventional elevating systems such as hydraulic cylinder or drawworks and winch elevating systems. In some implementations, the apparatuses and methods described herein may provide additional efficiencies because they may permit rig operators to fully rig-up the mast and drill floor at ground level, before the mast and/or drill floor are raised to the operating state. This may reduce the need for cranes and other support equipment at the drill site, streamlining the rig-up process.

The apparatuses and methods described herein may use a strand jack to erect or elevate a drilling structure. The strand jack may include a hollow hydraulic cylinder with a set of steel cables passing through its hollow center. Each cable passes through two clamps, with each of the two clamps being mounted at opposite ends of the hydraulic cylinder. This system operates by releasing the clamp from a cable at a lead end of the strand jack, extending the hydraulic cylinder, closing the clamp on the cable at the lead end at a new location on the cable, releasing the clamp from the cable at the trailing end of the strand jack, contracting the hydraulic cylinder, and closing the clamp on the cable at the trailing end before starting over again. Among other advantages, a strand jack uses steel cables reeved through sheaves to provide precise control with double clamping (e.g., clamping at the lead and trailing ends of the strand jack).

Unlike conventional hydraulic cylinders used to raise the drill floor and mast, the apparatuses and methods described herein provide double clamping for additional safety along with more precise control. Particularly, if a component in a conventional hydraulic cylinder fails (e.g., failure of a seal, a counterbalance valve, or a hose) while raising a drill floor and mast, the cylinder cannot prevent drill the floor and mast from collapsing. Such a failure can therefore be catastrophic, resulting in complete loss of a mast or portion of a drill floor. Unlike conventional systems, the strand jack systems and methods described herein use clamps set on the individual strands of cable ensuring that this type of a catastrophic event does not happen.

In addition, unlike conventional drawworks and winch raising systems, the apparatuses and methods can raise the mast and drill floor without the required generators, SCR/drives and full structural support. This allows the mast and drill floor structures to be raised in parallel with setting up the drilling site. That is, the mast and drill floor structures may be raised without first setting up the drawworks, generators, SCR/drives, and other systems conventionally used to erect masts and drill floors. Because these are done in parallel rather than in series, the strand jack methods and systems result in a faster setup of the drilling rig than conventional systems. This translates into earlier start times for actual drilling, making setup more efficient and economical.

The apparatuses and methods herein utilize cables and hydraulic cylinders to raise the mast and substructure. Where conventional drawworks and winch raising systems utilize numerous and complex sheave arrangements to develop a mechanical advantage, some implementations, but not all implementations, described herein utilize hydraulics to pull all the cables simultaneously.

FIG. 1 illustrates a schematic view of a drilling rig apparatus 100 demonstrating one or more aspects of the present disclosure. In some examples, the drilling rig apparatus 100 may form a part of a land-based, mobile drilling rig. One or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The drilling rig apparatus 100 shown in FIG. 1 includes a drill floor 102 and a mast 104 supported or extending from the drill floor 102, all disposed above a substructure 105. The drill floor 102 includes an upper facing main floor 106 and ground-facing portion 108. The drill floor 102 may be sized in a range of about 35×35 feet, although larger and smaller drill floors are contemplated. In some embodiments, the drilling rig 100 may have a drill floor size of less than approximately 1600 square feet. In other embodiments, the drilling rig apparatus 100 may have a drill floor size of less than approximately 1200 square feet. The main floor 106 supports rig-based operations and rig equipment, including the mast 104. In this embodiment, the main floor 106 supports a gantry or gin pole assembly shown as an A-frame support 110 anchored onto the drill floor 102 that may be utilized to raise the mast 104 and to anchor the mast 104 when in an upright position. While FIG. 1 shows a front plan view, it should be apparent that the A-frame support 110 may be formed of a plurality of A-frame structures that may be spaced across a width of the mast 104 and may be connected via support beams or other structures.

The drill floor 102 is supported above the substructure 105 by a collapsible vertically standing elevating drill floor frame including a plurality of struts 112, beams, or columns that extend from the substructure 105 to the drill floor 102. As can be seen, the drill floor 102 is located above the substructure 105 and is disposed over well center 130, which extends downward through the substructure 105. The mast 104 is disposed in a manner that enables it to conduct operations over well center 130 to accomplish desired drilling tasks. The substructure 105 is a substructure for supporting the drilling structure, such as the drill floor, on the surface through which drilling is to occur.

In this example, the struts 112 are brace members and may be disposed on each side of the drill floor 102 and may be arranged in pairs forming parallel linkages. The struts 112 include pivot anchors 114 at upper ends and include pivot anchors 115 at lower ends. These pivot anchors 114 attach an upper end of each strut 112 to the drill floor 102 at the ground facing portion 108 and the pivot anchors 115 attach a lower end of each strut 112 to the substructure 105. Additional struts and framework may be provided to stabilize the drill floor 102 on the struts 112 in order to maintain the struts in an upright position.

The mast in FIG. 1 is shown in the upright position and anchored in place relative to the drill floor 102 and the A-frame support 110. The mast 104 may have a height in the range of about 110-160 feet, although other lengths, both larger and smaller are contemplated. The mast 104 is configured to support drilling equipment, such as a traveling block and a top drive or other equipment that may be raised and lowered to drive a drill string or other drilling equipment downward into the well or take the drill string out from the well.

In the exemplary embodiment shown, the mast 104 includes a main body portion 118 having an upper end 120 and a lower end 122. The lower end 122 connects to the drill floor 102 at a pivot anchor 124 located to a side of the A-frame structure. It connects to the A-frame 110 at frame connector 121.

The main body portion 118 mast 104 may be comprised of one single module or a plurality of components connected together. The upper end 120 of the mast 104 includes a crown block 116 that may include one or more sheaves or other elements that may be used to raise and lower drilling equipment in the mast 104.

As described herein, the drilling rig apparatus 100 may be erected in a manner that may be more efficient, cost-effective, and may have a lower risk of damage to the rig and other equipment than conventional setup systems. A part of these advantages arises because unlike conventional masts that are raised using the rig drawworks and other equipment used for the drilling rig operation itself, the systems and methods described herein can erect the drilling rig without requiring the setup of a substantial portion of the rig site prior to erecting the drill floor or mast. In addition, a part of these advantages arises because there is no requirement that separate cranes, which can be unwieldy in some environments, be brought in to assist with erecting the drilling rig apparatus 100.

As described in this disclosure, the drill floor 102 and mast 104 are erected using a rigging system 140 including one or more strand jacks 142 disposed about the drilling rig apparatus 100 and in the substructure 105. Still referring to FIG. 1, the rigging system 140 includes the strand jack 142, a strand take-up reel 144, a strand clevis 146, and a plurality of rigging lines 150 including a pendant line 148, and sheaves 152. These are described in greater detail with reference to FIGS. 2-4.

Figure 2:
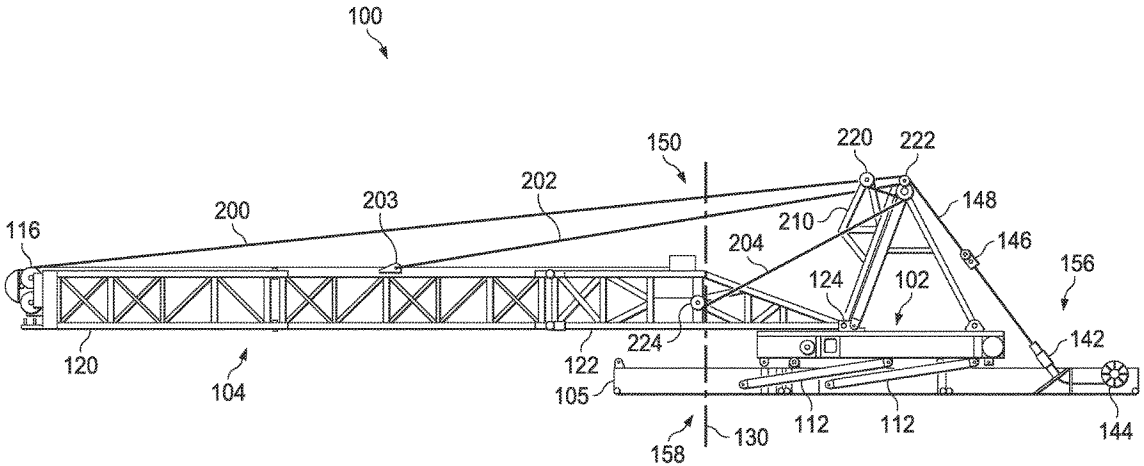
FIG. 2 is a side view of an apparatus in a collapsed configuration according to one or more aspects of the present disclosure.
Figure 3:
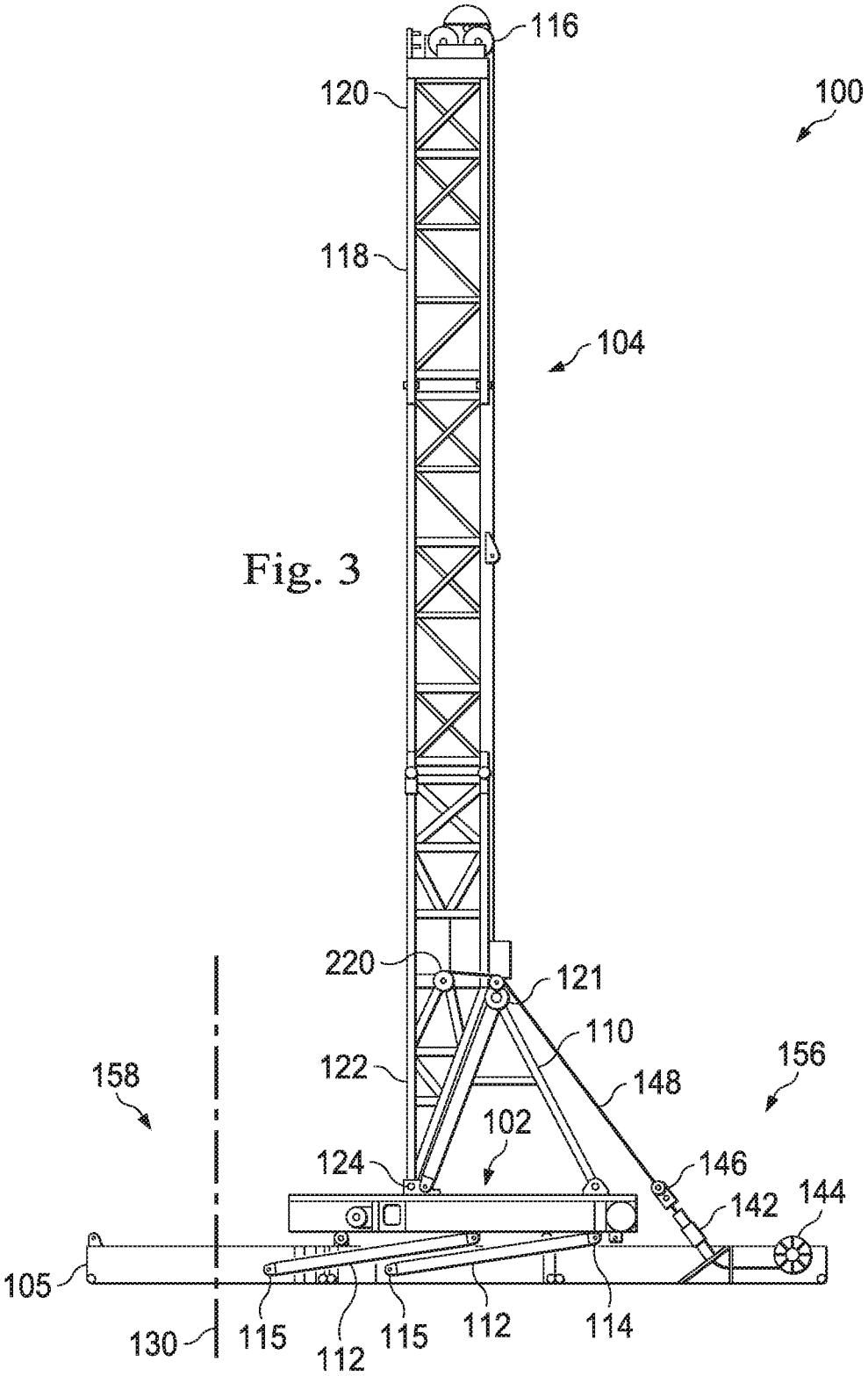
FIG. 3 is a side view of an apparatus in a partially erected configuration according to one or more aspects of the present disclosure.
Figure 4:
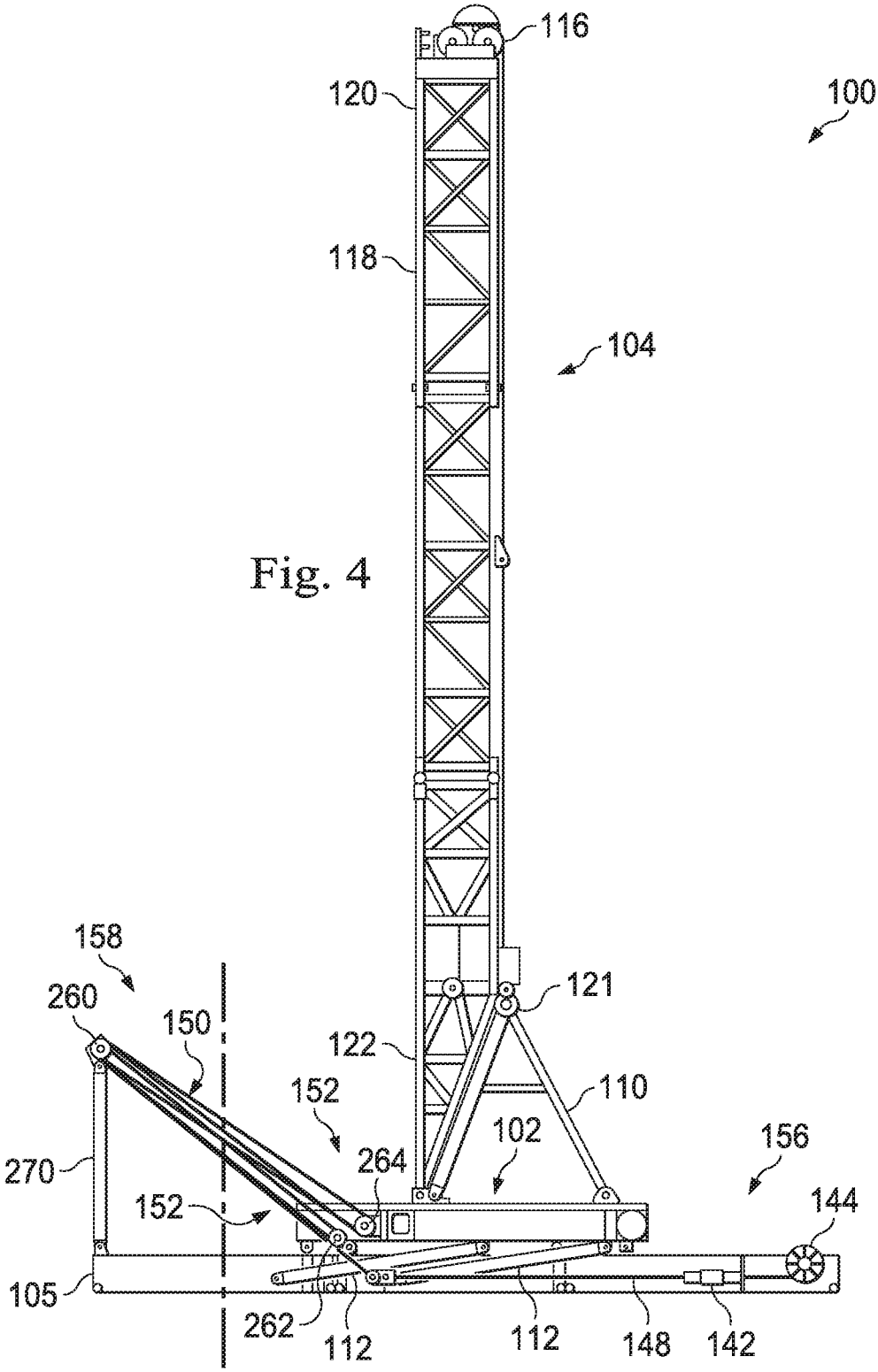
FIG. 4 is a side view of an apparatus in a partially erected configuration according to one or more aspects of the present disclosure.

FIG. 2 shows the drilling rig apparatus 100 in a pre-erected condition; FIG. 3 shows the drilling rig apparatus 100 with the mast 104 erected on the drill floor 102 and the drill floor in a collapsed condition, and FIG. 4 shows the drilling rig apparatus 100 arranged to raise the drill floor 102 above the substructure 105. FIG. 1 shows the drill floor 102 in the upright position.

For reference and understanding, the substructure 105 will be referred to as having a jack side 156, shown as being on one side of the drill floor 102, and a well center side 158, shown as being on the opposing side of the drill floor 102.

FIG. 2 shows the position of the drilling rig apparatus 100 before it has begun to be erected, but after it has been assembled. For example, the mast 104 may have been transported to the drill site in multiple parts, but is shown in FIG. 2 in a substantially assembled state. Likewise, the drill floor 102 may have been transported in multiple parts and is shown in a substantially assembled state, although it may or may not include rig equipment. The mast 104 connects to the drill floor 102 at the pivot anchor 124, but is shown lying horizontally in a reclined position on the ground adjacent the drill floor 102. In this embodiment, the mast 104 lies over the well center side 158 of the substructure 105. In FIG. 2, the rigging lines 150 include a jib line 200, a forstay line 202, and a hoist line 204. These connect to a jib 210 associated with and extending from the A-frame support 110. These rigging lines 150 connect to one or more pendant lines 148, which connects to one or more strand clevises 146, which connects to one or more strands that are retracted using the strand jack 142.

The jib line 200 connects to the mast at the crown block 116. The forstay line 202 connects the central region of the mast 104 at an anchor 203. The hoist line 204 connects to a lower portion of the mast 104 at one or more mast sheaves 224 disposed along an interior portion of the mast 104.

In this example, the strand jack 142 is anchored in the substructure 105 at the jack side 156, opposite the well center side 158 and opposite the direction of the reclining mast 104. The sheaves 152 in FIG. 2 include an elevating block with a jib sheave 220, an elevating block with A-frame sheaves 222, and an elevating block with the mast sheaves 224. The sheaves 152 rotate on bearings or bushings and are installed basically anywhere rigging lines are intended to turn or bend. The jib sheave 220 is disposed on the jib 210 on the well center side of the A-frame structure and at an elevation higher than the drill floor 102.

The strand jack raises the mast 104 from the position shown in FIG. 2 to the position shown in FIG. 3 by pulling the pendant line 148 until the mast 104 is erect. FIG. 3 shows the mast 104 in an erect or upright position after the pendant line 148 has been pulled by the strand jack 142. Referring to FIG. 3, the pendant line 148 is still connected to the hoist line 204. The jib line 200 and the forstay line 202 from FIG. 2 may have been disconnected from the pendant line 148 at the appropriate time while raising the mast 104. With the mast 104 in an upright position, the mast 104 may be connected or secured to the A-frame support 110 to provide stability and support to the mast 104.

Once the mast 104 is properly secured in place in an upright position, the rigging lines 150 may be rearranged to lift the drill floor 102 from its collapsed position on the ground or substructure 105 to its upright position. This is shown in FIG. 4.

Referring to FIG. 4, the rigging lines 150 are arranged differently in this embodiment to extend along the substructure 105 to the plurality of sheaves 152, which in this embodiment are disposed along the ground facing portion 108 of the drill floor 102. In this embodiment, the sheaves 154 include an elevating block with an elevated sheave 260 disposed on a support structure 270. Here the support structure 270 comprises one or more trusses, struts, or beams, but also may be any structure and may include any framework sufficiently strong and secure to assist in raising the drill floor. In some implementations, the support structure 270 may form a part of the drill floor frame. The rigging lines 150 and sheaves 152 are disposed and arranged to raise the drill floor 102 from the collapsed position shown in FIG. 3 to the upright position shown in FIG. 1. The elevated sheave 260 and the support structure 270 form a stabilizing portion for the drill floor 102 when in the upright or elevated position. Accordingly, the elevated sheave is disposed at substantially the same height as the drill floor 102 and may be used to pull the drill floor 102 toward it.

In addition to the elevated sheave 260, the sheaves 152 include an elevating block with base sheaves 262 and an elevating block with floor sheaves 264 that are arranged to allow the drill floor 102 to raise to its location in FIG. 1. The rigging lines 150 extend between the base sheaves 262, the floor sheaves 264, and the elevated sheaves 260.

In FIGS. 3 and 4, the drill floor 102 has been previously connected to the struts 112 via the upper pivot anchors 114. In addition, in this embodiment, the struts 112 are also connected to the substructure 105 at the lower pivot anchors 115. In use, the strand jack 142 is operated to apply loading or sufficient force on the pendant line 148 to move the pendant line 148 toward the take-up reel 144. This in turn forces the drill floor 102 to move toward the elevated sheave 260, thereby raising the drill floor 102 through an arc-like motion as it pivots about the pivot anchors 114, 115 as the struts 112 rotate from a relatively horizontal position as shown in FIG. 4 to a relatively vertical position as is shown in FIG. 1. The drill floor 102 is then secured in place using additional structure to prevent further movement or rotation of the pivot anchors 114. In this embodiment, the height of the drill floor 102 from the substructure 105 is dependent on the height of the struts 112.

Use of a strand jack 142 to raise the mast 104 and the drill floor 102 enables precise and even displacement with only a minimal level of risk of twisting or damaging the mast or drill floor due to uneven lifting as can occur when using dual hydraulic cylinders disposed along sides of the mast 104. In addition, strand jacks may be a more cost-effective solution than the hydraulic cylinders used in conventional systems to raise the mast or other part of the drilling rig. Furthermore, it may be much faster to set up the complete drilling pad than conventional systems that use rig equipment, such as a drawworks, to raise the mast because all tasks may be done in parallel, rather than in series.

At least a portion of the advantages of the systems and methods of the present disclosure arises from the use of a strand jack to accomplish the desired tasks. Operation of the strand jack is described with reference to FIGS. 5A-5D. These stylized schematic drawings show the relative movement and positioning of components of the strand jack 142. Referring to these figures, the strand jack 142 includes a hollow hydraulic cylinder 250, an upper clamp 252, and a lower clamp 254. The hydraulic cylinder 250, as shown in the exemplary cross-sectional drawings, includes a piston 256 and a body 258, where the piston 256 telescopes or extends from the body 258. In this embodiment, the lower clamp 254 is attached to the body 258, and the upper clamp 252 is attached to the piston 256. The pendant line extends through the hollow central portion of the cylinder 250 and can be clamped by either one or both of the upper and lower clamps 252, 254. Although only one pendant line 148 is shown for convenience, different embodiments may be arranged to receive and clamp onto any number of parallel pendant lines extending through the hydraulic cylinder 250. The upper and lower clamps 252, 254 of course are configured to clamp or secure each pendant line extending therethrough. In the exemplary implementation shown, the strand jack 142 is connected to the substructure 105.

Figure 5A:
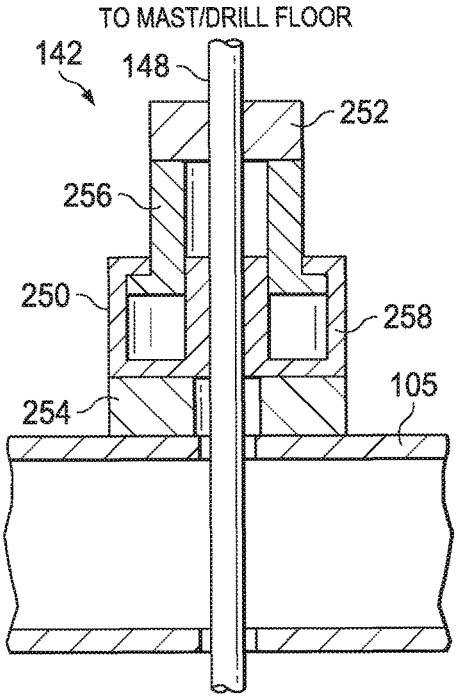
FIG. 5A is a cross-sectional view of an exemplary strand jack according to one or more aspects of the present disclosure.
Figure 5B:
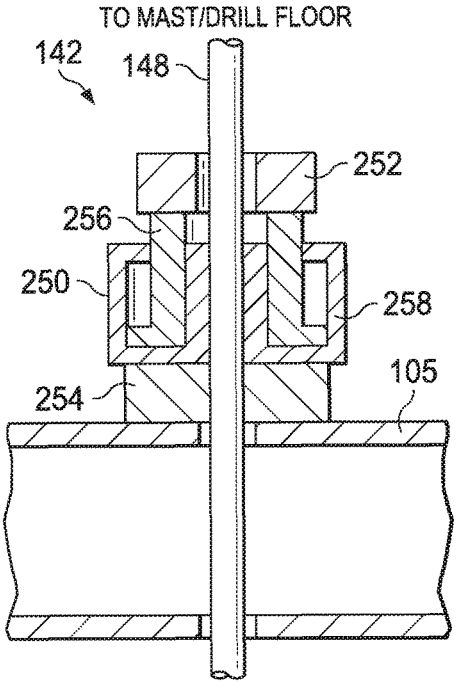
FIG. 5B is a cross-sectional view of an exemplary strand jack according to one or more aspects of the present disclosure.
Figure 5C:
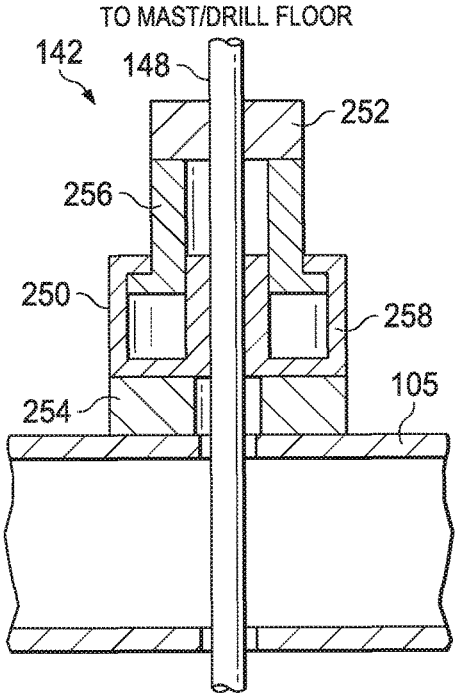
FIG. 5C is a cross-sectional view of an exemplary strand jack according to one or more aspects of the present disclosure.
Figure 5D:
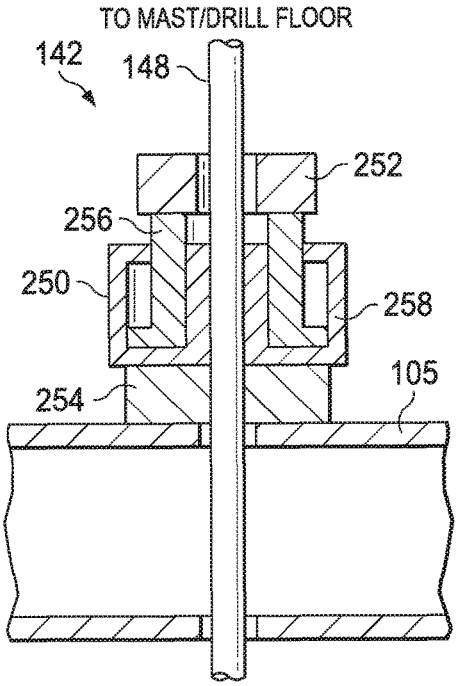
FIG. 5D is a cross-sectional view of an exemplary strand jack according to one or more aspects of the present disclosure.

With reference to FIG. 5A, the strand jack 142 is shown with the hydraulic cylinder 250 in an extended position. It operates by clamping the pendant line with upper clamp 252 to keep the pendant line from dropping. The lower clamp 254 is released from the pendant line. In this manner, the hydraulic cylinder 250 can be compressed to the position shown in FIG. 5B. This pulls the pendant line 148, raising the mast 104 or drill floor 102. After arriving at the position shown in FIG. 5B, the lower clamp 254 is clamped onto the pendant line 148, and the upper clamp 252 can then be released from the pendant line 148. Accordingly, at least one of the upper and lower clamps 254 are clamped on the pendant line at all times, preventing inadvertent release of the pendant line. As shown in FIG. 5C, with the lower clamp 254 clamped on the pendant line and the upper clamp 252 released from the pendent line, the cylinder 250 is moved to the extended position. Accordingly, during this portion of the strand jack operation, the pendant line is maintained in place, and does not advance relative to the mast or drill floor. When the hydraulic cylinder 250 arrives at the position shown in FIG. 5C, the upper clamp 252 clamps onto the pendant line and the lower clamp 254 releases the pendant line. The hydraulic cylinder 250 is then compressed to the position shown in FIG. 5D, thereby displacing the pendant line 148 and raising the mast or drill floor by the length of the hydraulic cylinder displacement.

In some embodiments, the method and system described herein includes a plurality of strand jacks all cooperating together to pull (or push depending on the arraignment) the pendant line to raise the mast or drill floor.

The mast and drill floor can be lowered to the ground by reversing the process and still using the strand jack to gradually lower the mast and/or drill floor to the ground position shown in FIG. 2.

While the strand jack 142 shown in FIG. 5 uses a single hydraulic cylinder, other strand jack embodiments have multiple cylinders on opposing sides of the strands. Yet other strand jacks are contemplated.

In some embodiments, the strand jacks are sized so that they are independently unable to accommodate the weight of the mast or drill floor. These embodiments may employ a plurality of strand jacks. In these instances, the drilling rig apparatus 100 may include a controller in communication with all the strand jacks. The controller may generate control signals to control the strand jacks so that they maintain nearly precisely the same amount of force applied and distance traveled in each one. For example, some drilling rig apparatuses 100 include a plurality of strand jacks, each individually capable of lifting about 1700 tons. The controller system may operate the plurality of strand jacks, such as twenty strand jacks, in a manner that they cooperate to lift about 34,000 tons. The controller may operate any number of jacks, from about, for example, between one and one hundred twenty strand jacks simultaneously, offering fingertip feel movement control over extremely massive objects. In some embodiments, the controller is configured to detect a failure of a seal, valve, or hose in the strand jack. It may then alert the operator, and the strand jack may be repaired or replaced. Unlike conventional hydraulic jacks used for lifting masts that have a very long stroke in the range of about 10 feet or more and that lift the mast entirely, the strand jack stroke is limited to, for example only, less than about three feet. As such, failure will not create the same level of damage as conventional hydraulic systems that are required to have a very long stroke in order to directly raise the mast.

The apparatus and method described herein provides for a level of precision control not obtained in conventional systems. It is worth noting that the strand jack expansion and contraction can be done at any speed, and paused at any location. It is worth noting that the arrangements in FIGS. 1-4 show exemplary rigging lines and sheave locations only. Other rigging lines in other arrangements used to properly and safely raise the mast 104 are also contemplated and within the scope of this enclosure.

Figure 11:
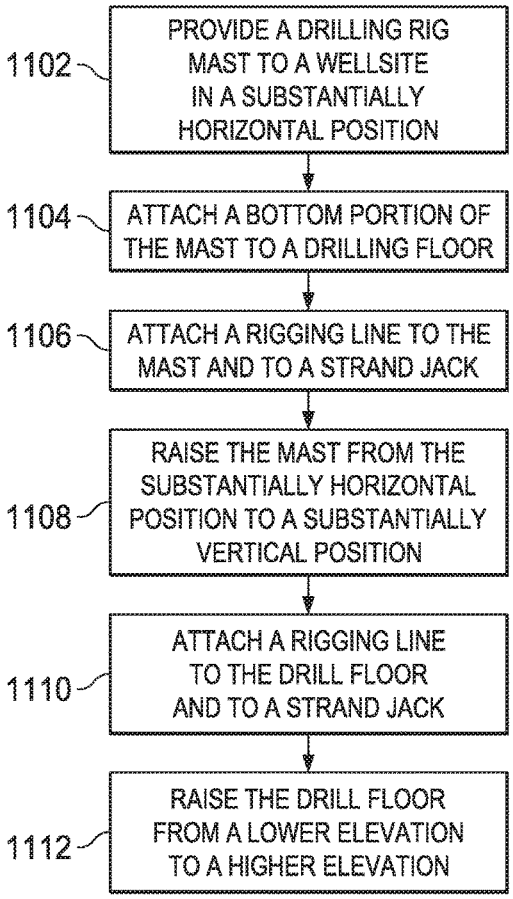
FIG. 11 is an exemplary flow chart showing a method of erecting portions of a drilling rig apparatus according to one or more aspects of the present disclosure.

FIG. 11 shows an exemplary method for raising or elevating drilling structures on the drilling rig apparatus 100. The method may begin at 1102, by providing a drilling rig mast to a wellsite in a substantially horizontal position. In some implementations, the mast may be assembled at the wellsite as described above. With the mast in a substantially horizontal position, elements of the mast, including sheaves, blocks, and cables may be properly assembled with the mast.

At 1104, a bottom portion of the mast may be attached to the drilling floor. In the implementation described herein, the bottom portion of the mast may be pivotably attached to the drilling floor, and the attachment may act as a fulcrum about which the mast rotates while being raised from the substantially horizontal position to a vertical position on the drill floor. In some implementations, the bottom portion of the mast may be rotatably attached to the drilling floor prior to assembly of the mast. For example, in some implementations, the mast is shipped to the drill site while connected to a portion of the drilling floor. In some implementations, a bottom portion of the mast is first connected to the drill floor, and then the remainder of the mast is assembled with the bottom portion of the mast.

At 1106, a rigging line is attached to the mast and to a strand jack. In some of the implementations described herein, the strand jack is secured to or mounted within the substructure. The substructure may provide a stable foundation from which the strand jack may operate to raise the drilling rig structures. The rigging line may be attached about blocks and sheaves in the manner described herein in order to lift or raise the mast. The strand jack may be arranged as described with reference to FIG. 5, to have at least one hydraulic jack and a plurality of clamps that alternatingly secure onto a rigging line and pull the rigging line intention. In some implementations, the rigging line may be attached to an elevating block higher in elevation than the mast while the mast is in the substantially horizontal position.

At 1108, the strand jacks may pull the rigging line to raise the mast from the substantially horizontal position to a substantially vertical position. In some implementations, multiple strand jacks are simultaneously employed to raise the mast. For example, a first strand jack may be disposed to pull on the left side of the mast, while a second strand jack may be disposed upon the right side of the mast, with both the first and second strand jacks pulling in parallel directions, at the same rate. The strand jacks may then cooperate together to pull the left and right sides, at the same rate, to provide a balanced force on the rigging to lift the mast. As indicated herein, this may require operating the strand jacks in unison, although they may be disposed on opposing sides operating in parallel. In this manner, the strand jacks may effectively raise the mast without requiring full set up of other components of the drilling rig, such as the drawworks or other equipment. With the mast in a substantially vertical or erected condition, the mast may be secured in place to an A-frame or other structure in the manner described with reference to FIGS. 1-4.

With the mast in a substantially vertical position, the drill floor may next be raised using the strand jack. At 1110, the rigging line may be re-arranged to attach to the drill floor and to the strand jack. In some implementations, the strand jack may be arranged at a different location than when used to raise the mast. In other implementations, the strand jack may be arranged at the same location used to raise the mast. In some implementations the rigging line may be attached in a manner similar to that shown and described with reference to FIGS. 1-4. In some implementations, the rigging line may be attached to a support structure, such as the elevated support structure 270 described herein.

At 1112, the strand jack may pull the rigging line to raise the drill floor from a lower elevation to a higher elevation. In some implementations, this may include raising the drill floor by pivoting the drill floor about struts, beams, or columns that pivotably connect the drill floor to a substructure in the manner shown and described with reference to FIGS. 1-4. Particularly, the drill floor may travel in an arc from a position adjacent to or at a side of well center to a position over well center. In other implementations, the drill floor may be erected in other ways. With the drill floor at its operable elevation, the drill floor may be secured in place. In some implementations, pins or connectors may be used to prevent the struts, beams, or columns from further pivoting. Additional beams or pins may be used to safely and securely hold the drilling floor in place. In some implementations, the drilling floor may include all of the required drilling equipment prior to being raised. This may create efficiencies by reducing the need to lift equipment to an elevated drill floor. Other advantages would be apparent to one of ordinary skill in the art.

While FIGS. 1-4 show erecting components of the drilling rig apparatus 100 by pivoting structure, such as the mast and the drill floor about pivot points, other implementations include erecting components of the drilling rig apparatus 100 in a substantially vertical direction. FIGS. 6-10, for example, show a series of incremental schematics of a drill floor being raised in a substantially vertical direction using strand jacks 142.

Figure 6:
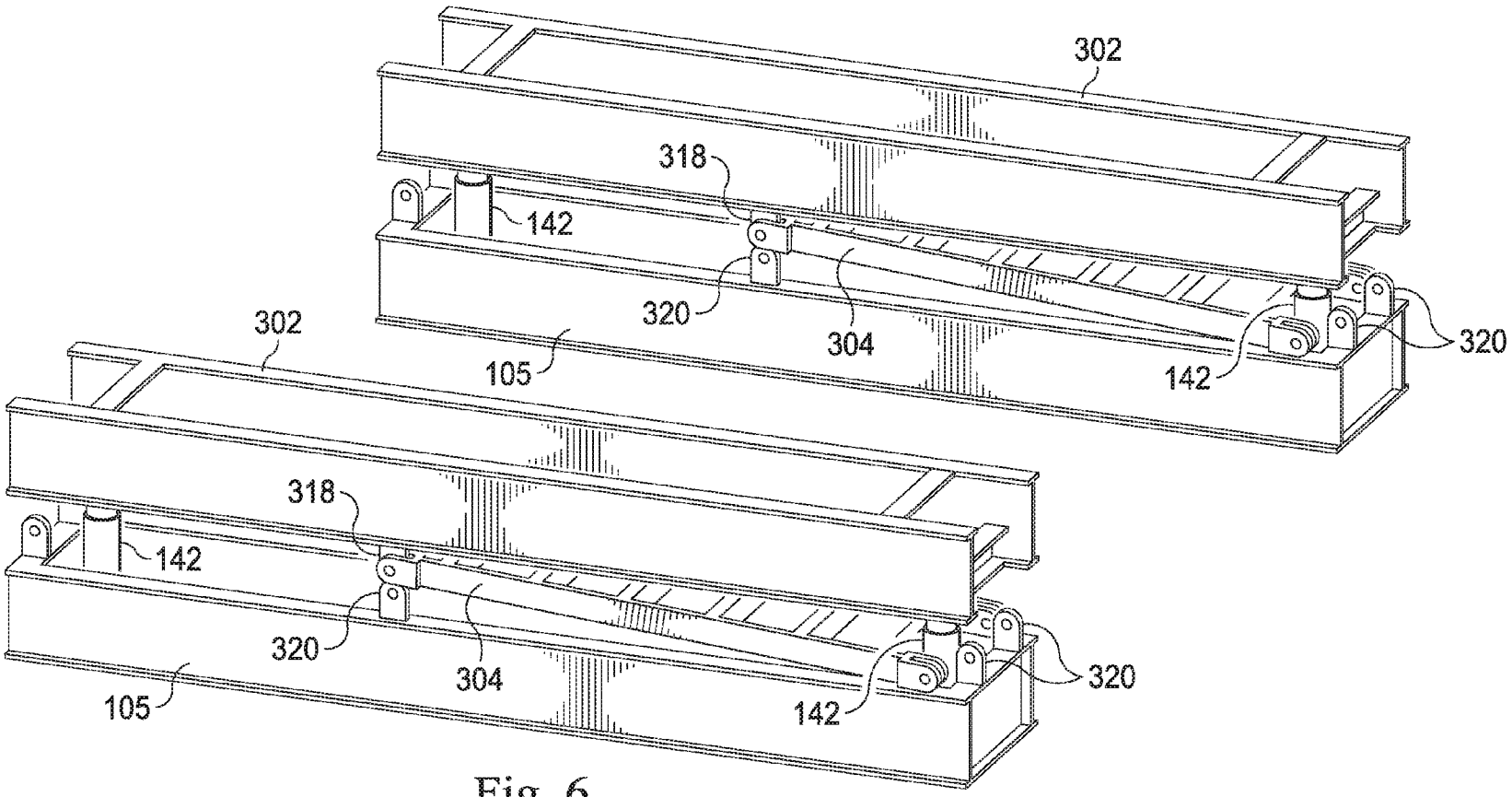
FIG. 6 is a perspective view of an apparatus in a pre-assembled configuration according to one or more aspects of the present disclosure.

FIG. 6 shows the substructure 105 and two stabilizing side components 302 of the drill floor 102 (the central portion of the drill floor is not shown in order to provide clarity to the stabilizing side components 302). The stabilizing side components 302 are disposed above the substructure 105, and in some implementations, rest upon the substructure 105. The stabilizing side components 302 are structurally arranged to support the drill floor, and may form trusses for the drill floor or other structural components that may bear weight of the drill floor and drill equipment that may be disposed on the drill floor. In this implementation, the stabilizing side components 302 each include one or more pivot anchors 318 that may be used for attachment to struts or other support members to either stabilize the drill floor or bear weight of the drill floor. While described as pivot anchors, other implementations use anchors that do not pivot and that may provide stabilizing support to the struts, beams, or columns that may bear the weight of the drill floor. In the implementation shown, the pivot anchors 318 are disposed in a position substantially centered between opposing ends of the stabilizing side components 302. However, the position of the pivot anchors 318 may depend upon the length of the stabilizing side components 302 and the type of drill floor to be carried by the stabilizing side components 302. It is worth noting that the number of stabilizing side components 302 may vary depending upon the implementation, the rig type or size, and the drill floor type or size. In some implementations, the drilling rig apparatus may include several stabilizing side components 302 that may serve as a foundation or solid base for the drill floor. In FIG. 6, the stabilizing side components 302 are disposed in a collapsed position.

The substructure 105 may be disposed directly on a drilling pad and may form a part of the foundation upon which the drilling rig apparatus may stand. In this implementation, the substructure 105 is shown in two portions spaced apart from one another. In this implementation, the portions are disposed substantially parallel to each other, and extend in the longitudinal direction from one end to the other. Accordingly, the substructure portions may lay side-by-side on a drilling pad or other stable foundation. Other implementations include only one substructure portion, and yet others include three or more substructure portions. It should also be apparent to one of ordinary skill in the art that the two portions may be connected together for stability or in some instances may be formed of a single component that may serve as a substructure for the drilling rig apparatus 100. The substructure 105 may include one or more pivot anchors 320 that may be used to attach struts or other support beams that may provide stability to, or carry the weight of, the stabilizing side components 302 and the drill floor. The pivot anchors 320, like the pivot anchors 318, may be replaced with anchors that do not pivot but that still provide stabilizing support to the struts, beams, or columns that may bear the weight of the drill floor.

In this exemplary implementation, a strut 304 is disposed between each stabilizing side component 302 and the substructure 105. In the exemplary implementation shown, the struts are formed of beams connected by crossbars and may be connected to either the stabilizing side components 302 or the substructure 105 at multiple points. In the exemplary embodiment shown, one end of the struts 304 is pivotably connected to the pivot anchors 318 of the stabilizing side components 302. However, the opposing end of the strut 304 may be unconnected or not rigidly fixed to a rigid structure when the stabilizing side components are in a collapsed position. The struts 304 may be pivotably connected to the stabilizing side components 302 as will become apparent in subsequent FIGS.

In the exemplary implementation shown, strand jacks 142 are disposed at each corner of the stabilizing side components 302. In this implementation, the strand jacks 142 are connected to the stabilizing side components 302. In the implementation shown, four strand jacks 142 are shown. In other implementations, additional strand jacks may be used to vertically raise the drill floor to an elevated position for drilling rig operations. The strand jacks operate to raise the stabilizing side components (forming a part of the drill floor) from a collapsed position to an upright position.

Figure 7:
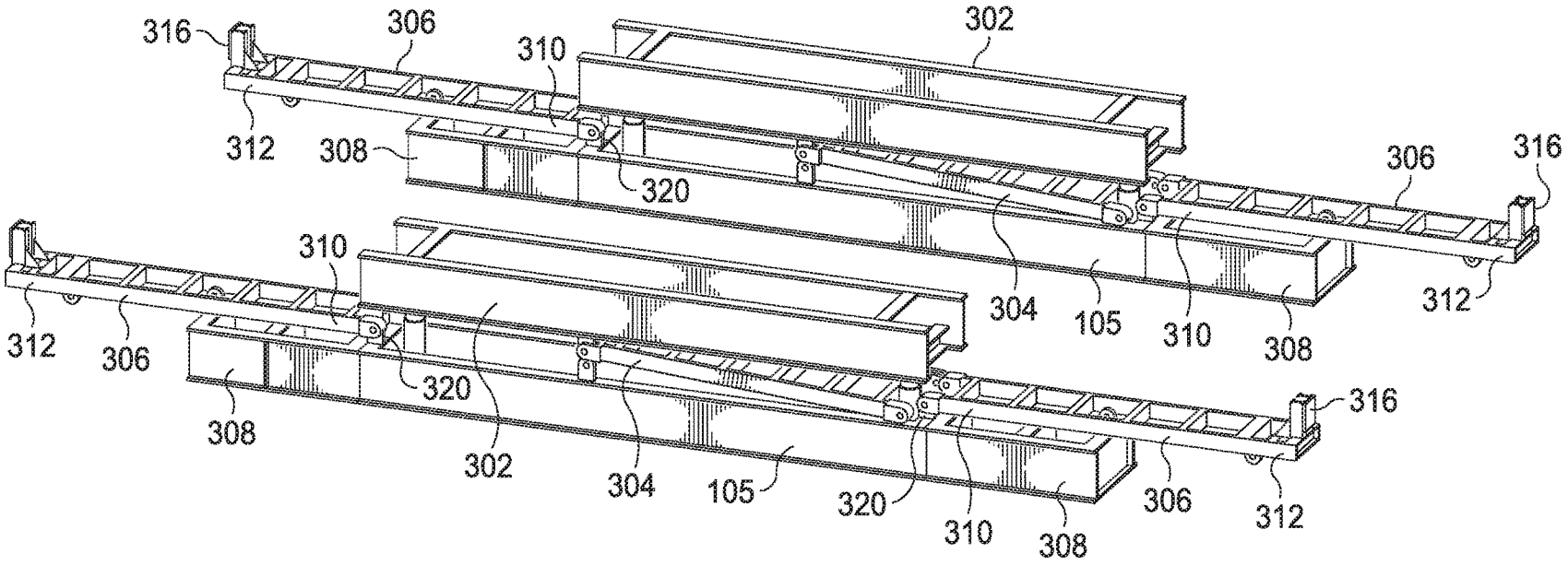
FIG. 7 is a perspective view of an apparatus with hoisting towers/legs in a pre-erected configuration according to one or more aspects of the present disclosure.

FIG. 7 shows additional side struts 306 and additional substructure portions 308 in place relative to the stabilizing side components 302. These components may be added to provide additional strength and support to the drill floor. In some implementations, these additional components may extend the footprint of the substructure 105, further stabilizing the drilling rig apparatus. In the implementation shown, the side struts 306 are pivotably attached to the substructure 105. In other implementations, the side struts 306 are disposed on the additional substructure portions 308. In other implementations, the side struts 306 are rigidly attached to the substructure 105, and therefore may not be pivotable relative to the substructure 105. In this embodiment, the side struts 306 include a pivot end 310 pivotably attached to pivot anchors 320 on the substructure 105. The side struts 306 also include a stabilizing end 312 arranged to interface with the stabilizing side components 302 when the side struts 306 are in a vertical position. This will become apparent further below with reference to FIG. 10.

The additional substructure portions 308 may be optional and are attached to ends of the substructure portion 105. The substructure portions are configured to further stabilize the substructure portion 105. In this exemplary embodiment, the substructure portions 308 support the additional side struts 306 when they are in a flat or collapsed position. Although FIG. 8 shows the additional side struts 306 connected to the substructure portion 105, in other implementations the side struts 306 may be connected to the additional substructure portions 308.

Figure 8:
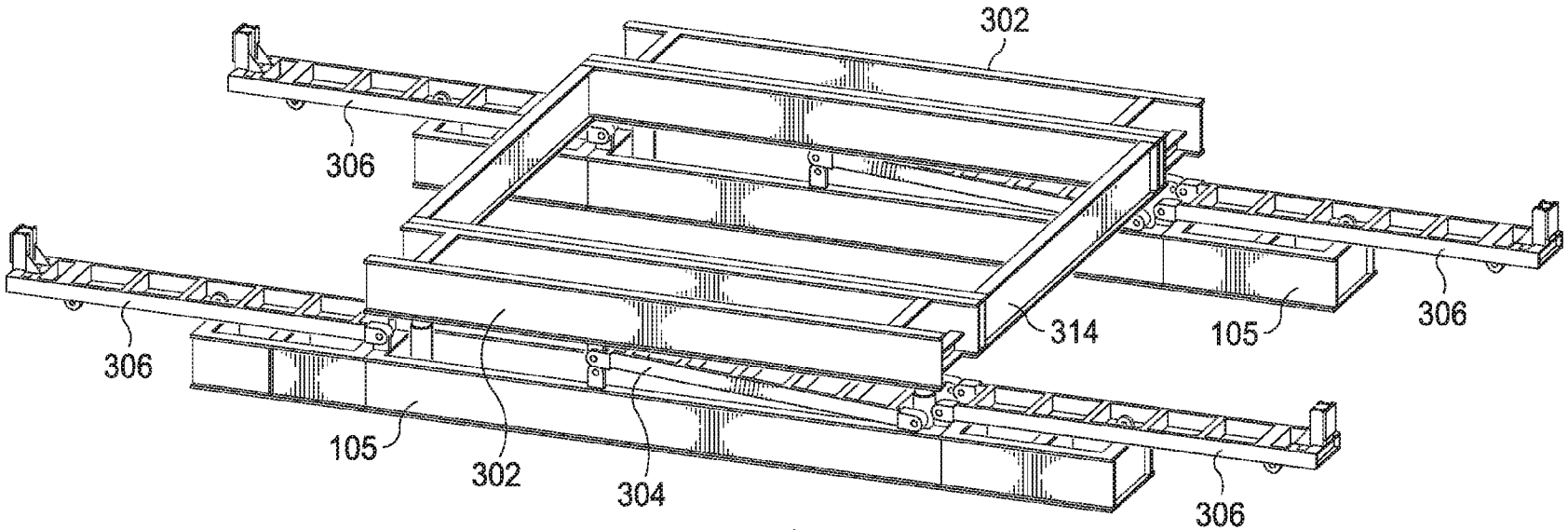
FIG. 8 is a perspective view of an apparatus with legs, a substructure, and a drillfloor in a pre-erected configuration according to one or more aspects of the present disclosure.

FIG. 8 shows a drill floor frame 314 attached to the stabilizing side components 302. The drill floor frame 314 may be attached to sides of the stabilizing side components 302 as shown in FIG. 8, or may be disposed above or on top of the stabilizing side components 302. In some implementations, the drill floor frame 314 provides stability by connecting multiple stabilizing side components 302. In some drilling rig apparatus assembly processes, the drill floor frame 314 may be attached to the stabilizing side components 302 after the substructure portion 105 is properly positioned on a drill pad. In some drilling rig apparatus assembly processes, the drill floor frame 314 may be permanently attached to the stabilizing side components 302. Accordingly, in such implementations, the stabilizing side components 302 and the drill floor frame 314 may be simultaneously introduced onto the substructure 105. With the additional side struts 306 and the additional substructure portions 308 in place, the side struts 306 may be raised to a vertical position, as shown in FIG. 9.

Figure 9:
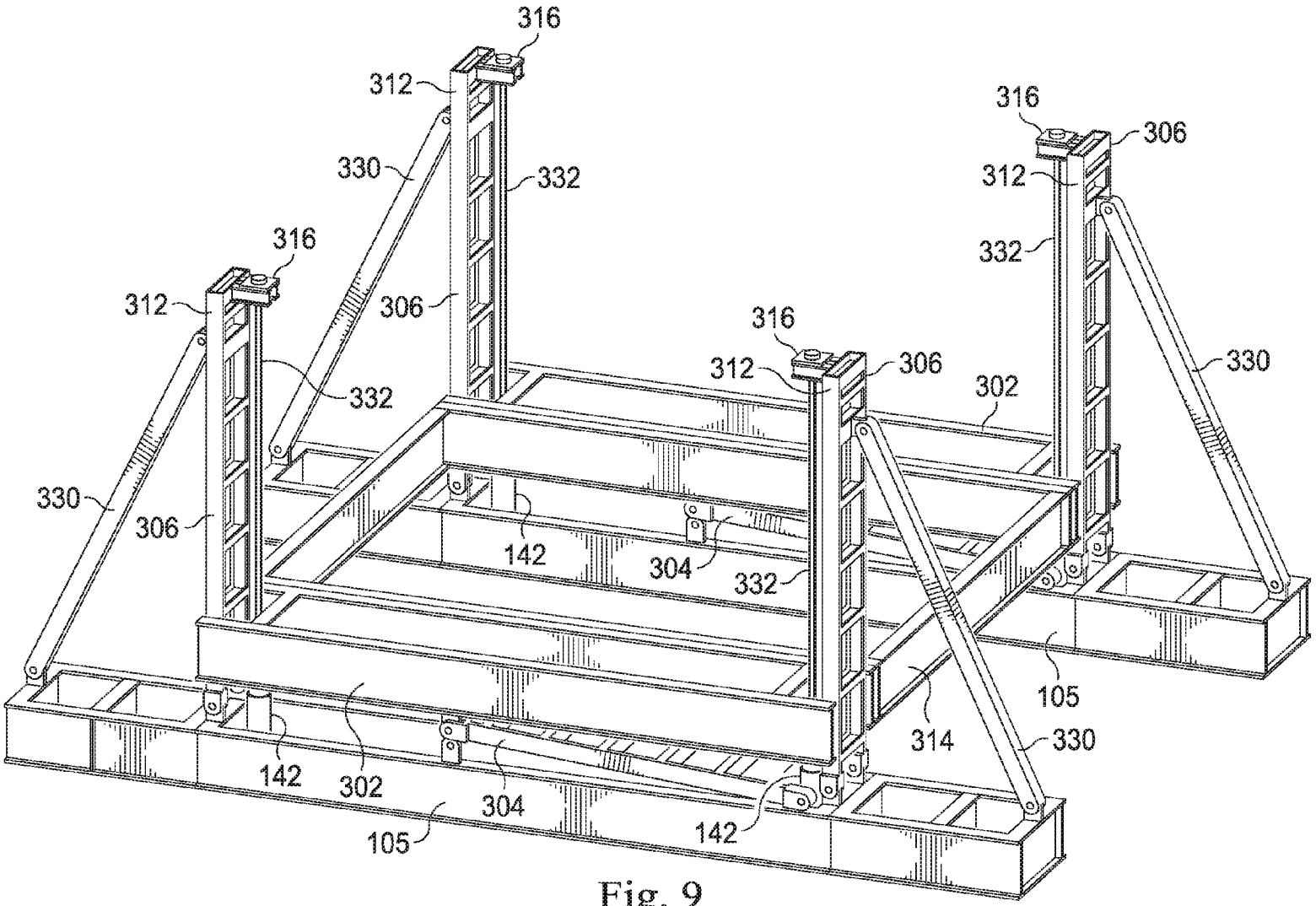
FIG. 9 is a perspective view of an apparatus with legs, a substructure, and a drillfloor in a pre-erected configuration according to one or more aspects of the present disclosure.

FIG. 9 shows the side struts 306 in an upright position. These have pivoted at the pivot anchors 320 to the upright position from a collapsed or horizontal position. In this implementation, the side struts may be held in place by side strut supports 330 to prevent the side struts 306 from falling or collapsing.

As shown in FIG. 9, each of the side struts 306 includes a bracket 316 at the stabilizing end 312 that is configured to engage a rigging line 332. In this implementation, the rigging line 332 may be a strand or cable. The rigging lines 332 also may extend downwardly to and attach to the strand jacks 142. The strand jacks 142 may be attached to the stabilizing side components.

Figure 10:
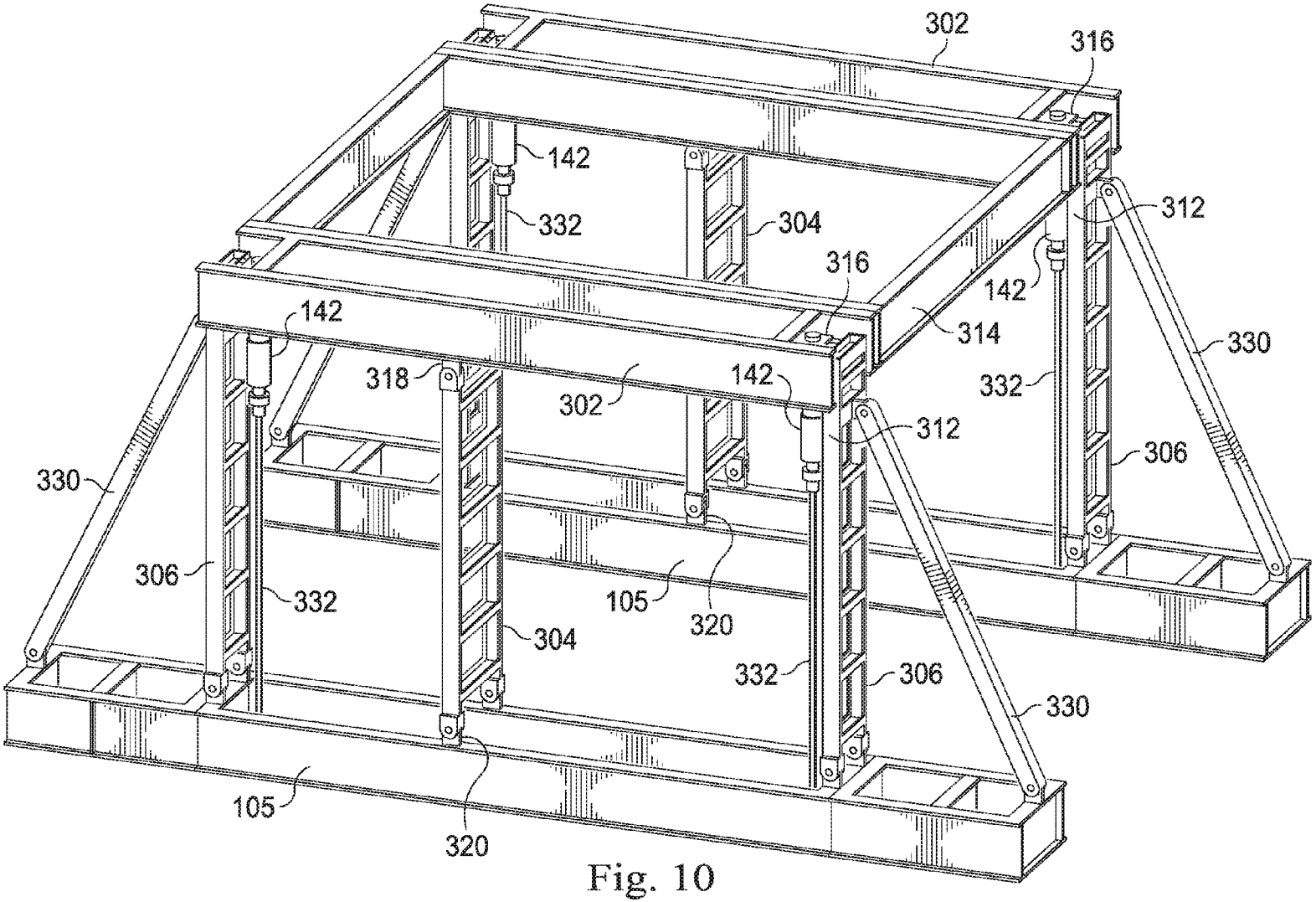
FIG. 10 is a perspective view of an assembled and erected apparatus according to one or more aspects of the present disclosure.

FIG. 10 shows the drill floor frame 314 and the stabilizing side components 302 raised to an upright position from the collapsed position. This may be done by controlling the strand jacks 142 to act in unison to raise each corner of the drill floor. This may be done because the strand jacks are attached to or supporting the underside of the stabilizing side components 302. The strand jacks 142 may operate in the manner described herein, with multiple clamps that cooperate to ensure that the strand jacks advance along the rigging lines 332 in a safe and predictable manner. As the strand jacks 142 advances along the strand or rigging line 332, the stabilizing side components 302 also advance along the strand or rigging line 332. Thus, the strand jacks 142 carry the drill floor to the upright, elevated position. When the stabilizing side components 302 reach the stabilizing end 312 of the side struts 306, the stabilizing side components 302 may be fixed to the brackets 316 to provide a stable structure for the drill floor and for the components that may be disposed thereon.

In this implementation, the struts 304 are also shown in the vertical condition and arranged to provide support to the drill floor 102 to keep it from collapsing. The struts 304 may be pinned or otherwise attached to both the pivot anchors 320 on the substructure 105 and the pivot anchors 318 on the stabilizing side components 302. The stabilizing side components 302 may be fixed in position to the side struts 306 to provide solid, stabilized support to the drill floor.

Figure 12:
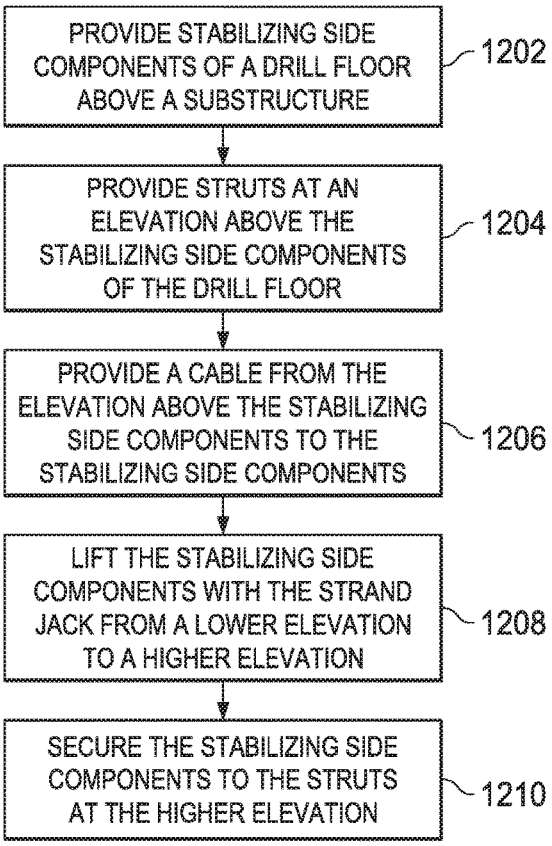
FIG. 12 is an exemplary flow chart showing a method of erecting portions of a drilling rig apparatus according to one or more aspects of the present disclosure.

FIG. 12 shows a method of assembling and erecting a drill floor according to the exemplary implementation described with reference to FIGS. 6-10. At 1202, the method begins by providing stabilizing side components of the drill floor above a substructure. In this implementation, the stabilizing side components represent the drill floor. The drill floor may be in a fully assembled condition, or in some implementations may be in only a partially assembled condition. FIGS. 6-10 illustrate stabilizing side components, rather than a solid drill floor merely for clarity. Accordingly, the discussion of the stabilizing side components may be equally understood to apply to an assembled drill floor.

At 1204, struts, beams, or columns may extend to or may be disposed at an elevation above the stabilizing side components of the drill floor. In the implementation shown in FIGS. 6-10, these may be pivotably connected to the substructure. The struts, beams, or columns may include a bracket or other connector that may be used to anchor a cable, a sheave, or other component that may assist with the rigging or advancement of the drill floor to an elevated position.

At 1206, a cable may be extended from the elevation above the stabilizing side components to the side components. The cable may be a single strand anchored at the top of the struts, beams, or columns, or may be multiple strands and sheaves, with a block or other element supported by the struts, beams, or columns. The cable may be connected to the side components through sheaves, blocks, or other components as well. In the implementation shown in FIGS. 6-10, the strand jacks are directly connected to the stabilizing side components.

At 1208, the stabilizing side components, and therefore the drill floor itself, may be lifted by using the strand jacks from a lower elevation to a higher elevation. In the example shown, a strand jack is disposed at each corner of the drill floor. These four strand jacks operate in parallel and in unison to raise the drill floor in the vertical direction. In the implementation shown in FIGS. 6-10, the cable extends from a top of the strut to the strand jack, which is connected to the stabilizing side component. Accordingly, as the strand jack advances along the cable, the stabilizing side component rises from a lower elevation to a higher elevation.

At 1210, the stabilizing side components are secured at the higher elevation. As indicated above, this may be done using pin connections or other types of connections to securely maintain the stabilizing side components at the higher elevation. In some instances, the stabilizing side components are pinned directly to the struts, beams, or columns.

In view of all of the above and the figures, one of ordinary skill in the art will readily recognize that the present disclosure introduces a method for erecting a drilling structure, and may include providing a drilling rig mast to a wellsite in a substantially horizontal position; attaching a bottom portion of the mast to a drilling floor; attaching a rigging line to the mast and to a strand jack arranged with at least one hydraulic jack and a plurality of clamps that alternatingly secure onto a rigging line and pull the rigging line in tension; and pulling the rigging line with the strand jack to raise the mast from the substantially horizontal position to a substantially vertical position.

In some implementations, attaching a rigging line to the mast and to the strand jack may include attaching a first rigging line to a first strand jack and attaching a second rigging line to a second strand jack. Each of the first and second rigging lines may be attached to opposing sides of the mast. Pulling the rigging line with the strand jack may include operating the first and second strand jacks in unison to balance the mast and raise the mast to the substantially vertical position. The method may also include attaching the first rigging line to an elevating block that is higher in elevation than the mast while the mast is in the substantially horizontal position. In some implementations, the strand jack may be secured to a substructure on the ground spaced apart from the drilling floor, the substructure being disposed at an elevation lower than the drilling floor. In some implementations, the drilling floor is disposed in a collapsed position above the substructure. The method may also include using a strand jack to raise the drilling floor after erecting the mast to a standing position. In some implementations, attaching a rigging line includes attaching a first rigging line to a mid-portion of the mast, attaching a second rigging line to a top portion of the mast, and attaching a third rigging line to a bottom portion of the mast.

In another exemplary implementation, the present disclosure introduces a method for erecting a drilling structure that may include attaching a rigging line to a drill floor and to a strand jack arranged with at least one hydraulic jack and a plurality of clamps that alternatingly secure onto a rigging line and pull the rigging line in tension; pulling the rigging line with the strand jack to raise the drill floor from a collapsed position to an elevated position; and securing the drill floor at the elevated position to perform drilling operations on the drill floor.

The method may also include attaching the rigging line to an elevating block disposed at an elevation higher than the elevation of the drill floor, the rigging line extending from the elevating block and passing underneath the rig floor to the strand jack. In some implementations, the elevating block may be disposed at substantially the same elevation as the drill floor when the drill floor is positioned at the elevated position. The method may also include attaching the rigging line to an elevating block disposed at an elevation higher than the elevation of the drill floor. The rigging line may extend in a substantially vertical direction from the drill floor to the elevating block such that pulling the rigging line raises the drill floor vertically to the elevated position. In some implementations, the drill floor may include a plurality of elevating blocks and the rigging extends about the elevating blocks. In some implementations, the struts may be pivotably connected to both the drill floor and the substructure, such that the struts pivot on the substructure as the drill floor travels in an arc. In some implementations, pulling the rigging line with the strand jack may include moving the drill floor from the collapsed position disposed laterally of a desired well center to a position above the desired well center for drilling. In some implementations, the rigging line may extend from a sheave on the drill floor to a sheave disposed at an elevation higher than the drill floor, and from the sheave disposed at an elevation higher than the drill floor to a sheave disposed on the substructure, and from the sheave disposed on the substructure to the strand jack. In some implementations, attaching a rigging line to the drill floor and to a strand jack may include attaching a plurality of rigging lines to the drill floor and to a plurality of strand jacks, and pulling the rigging line may include controlling the plurality of strand jacks to operate in sequence to pull the rigging lines at the same rate to raise the drill floor from the substantially horizontal position to the substantially vertical position.

In yet further implementations, the present disclosure introduces a drilling structure that may include a substructure for supporting the drilling structure on a ground surface through which drilling is to occur; an elevatable drill floor; a collapsible drill floor frame attachable to the drill floor and to the substructure in a manner permitting the drill floor to rest on the substructure when the drill floor frame is in a first collapsed position and in a manner supporting the drill floor above the substructure in an elevated second position, the drill floor frame comprising a plurality of strut members on opposing side portions of the drill floor, the strut members of the drill floor frame being arranged in pairs forming parallel linkages; a first elevating block mounted to said drill floor; a second elevating block mounted at an elevation above the drill floor when the drill floor frame is in a collapsed position; an elevating line extending between the first elevating block and the second elevating block; and a strand jack including at least one hydraulic jack and a plurality of clamps that alternatingly secure onto the elevating line and pull the elevating line in tension, the strand jack and elevating line being arranged so that pulling by said strand jack causes said first elevating block to move toward said second elevating block in a manner that raises the drill floor to the elevated position.

The drilling structure may also include a third elevating block disposed in the substructure below the drill floor, the elevating line extending from the second elevating block to the third elevating block and to the strand jack. In some implementations, the drill floor may be disposed to the side of a desired well center location when in the collapsed position and disposed above the desired well center location when in the upright position. In some implementations, the support structure assembly on the elevator drill floor may include a third elevating block, a rigging line extendable from the mast to the third elevating block and to the strand jack when the strand jack is used to raise the mast to the upright position. The drilling structure may also include a mast pivotably connected to the drill floor while the drill floor frame is in the collapsed position.

In yet other implementations, the present disclosure introduces a method for erecting a drilling structure that may include attaching a plurality of struts to a drill floor of a drilling rig, the plurality of struts extending in a vertical condition; attaching the plurality of struts to a substructure below the drill floor; attaching a rigging line between each of the struts extending above the drill floor and to a strand jack arranged with at least one hydraulic jack and a plurality of clamps that alternatingly secure onto the rigging line and pull the rigging line in tension; and pulling the rigging line with the strand jack to raise the drill floor from the collapsed condition to an elevated condition such that the drill floor travels vertically perpendicular to its legs until it is fully raised and attached adjacent a top of the struts in the vertical condition.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

We claim:

1. A method for erecting a drilling structure, comprising:

providing a drilling rig mast to a wellsite in a substantially horizontal position;

attaching a bottom portion of the mast to a drilling floor;

attaching a rigging line to the mast and to a strand jack arranged with at least one hydraulic jack and a plurality of clamps, each clamp of the plurality of clamps being arranged to unclamp and to clamp onto the rigging line, with at least one of the plurality of clamps being clamped onto the rigging line at all times while pulling the rigging line in tension; and pulling the rigging line with the strand jack to raise the mast from the substantially horizontal position to a substantially vertical position.

2. The method of claim 1, wherein attaching the rigging line to the mast and to the strand jack comprises attaching a first rigging line to a first strand jack and attaching a second rigging line to a second strand jack, each of the first and second rigging lines being attached to opposing sides of the mast; and wherein pulling the rigging line with the strand jack comprises operating the first and second strand jacks in unison to balance the mast and raise the mast to the substantially vertical position.

3. The method of claim 1, comprising attaching the rigging line to an elevating block that is higher in elevation than the mast while the mast is in the substantially horizontal position.

4. The method of claim 1, wherein the strand jack is secured to a substructure on the ground spaced apart from the drilling floor, the substructure being disposed at an elevation lower than the drilling floor.

5. The method of claim 4, wherein the drilling floor is disposed in a collapsed position above the substructure.

6. The method of claim 5, which comprises using the strand jack to raise the drilling floor after erecting the mast to a standing position.

7. The method of claim 5, which comprises using a second strand jack to raise the drilling floor after erecting the mast to a standing position.

8. The method of claim 1, wherein attaching a rigging line includes attaching a first rigging line to a mid-portion of the mast, attaching a second rigging line to a top portion of the mast, and attaching a third rigging line to a bottom portion of the mast.

9. A method for erecting a drilling structure, comprising:

providing a drilling rig mast in a substantially horizontal position;

attaching a rigging line to the mast and to a strand jack comprising at least one hydraulic jack, a first clamp, and a second clamp, each of the first clamp and the second clamp being arranged to unclamp and to clamp onto the rigging line, with at least one of the plurality of clamps being clamped onto the rigging line at all times while pulling the rigging line in tension; and pulling the rigging line with the strand jack to raise the mast from the substantially horizontal position to a substantially vertical position.

10. The method of claim 9, wherein attaching the rigging line to the mast and to the strand jack comprises attaching a first rigging line to a first strand jack and attaching a second rigging line to a second strand jack, each of the first and second rigging lines being attached to opposing sides of the mast; and wherein pulling the rigging line with the strand jack comprises operating the first and second strand jacks in unison to balance the mast and raise the mast to the substantially vertical position.

11. The method of claim 9, comprising attaching the rigging line to an elevating block that is higher in elevation than the mast while the mast is in the substantially horizontal position.

12. The method of claim 9, wherein the strand jack is secured to a substructure on the ground spaced apart from the drilling floor, the substructure being disposed at an elevation lower than the drilling floor.

13. The method of claim 12, wherein the drilling floor is disposed in a collapsed position above the substructure.

14. The method of claim 13, which comprises using the strand jack to raise the drilling floor after erecting the mast to a standing position.

15. The method of claim 13, which comprises using a second strand jack to raise the drilling floor after erecting the mast to a standing position.

16. The method of claim 9, wherein attaching a rigging line includes attaching a first rigging line to a mid-portion of the mast, attaching a second rigging line to a top portion of the mast, and attaching a third rigging line to a bottom portion of the mast.

17. A method for erecting a drilling structure, comprising:

providing a drilling rig mast in a substantially horizontal position;

attaching a rigging line to the mast and to a strand jack comprising at least one hydraulic jack, a first clamp, and a second clamp, the at least one hydraulic jack having a cylinder and having a piston extendable relative to the cylinder, the first clamp being fixed relative to the piston and the second clamp being fixed relative to the cylinder, each of the first clamp and the second clamp being arranged to unclamp and to clamp onto the rigging line, with at least one of the first and second clamps being clamped onto the rigging line while pulling the rigging line in tension; and pulling the rigging line with the strand jack to raise the mast from the substantially horizontal position to a substantially vertical position.

18. The method of claim 17, wherein attaching the rigging line to the mast and to the strand jack comprises attaching a first rigging line to a first strand jack and attaching a second rigging line to a second strand jack, each of the first and second rigging lines being attached to opposing sides of the mast; and wherein pulling the rigging line with the strand jack comprises operating the first and second strand jacks in unison to balance the mast and raise the mast to the substantially vertical position.

19. The method of claim 17, comprising attaching the rigging line to an elevating block that is higher in elevation than the mast while the mast is in the substantially horizontal position.

20. The method of claim 17, wherein the strand jack is secured to a substructure on the ground spaced apart from the drilling floor, the substructure being disposed at an elevation lower than the drilling floor.

21. The method of claim 20, wherein the drilling floor is disposed in a collapsed position above the substructure.

22. The method of claim 17, wherein attaching a rigging line includes attaching a first rigging line to a mid-portion of the mast, attaching a second rigging line to a top portion of the mast, and attaching a third rigging line to a bottom portion of the mast.

* * * * *